US009709373B2

(12) United States Patent
Hikone et al.

(10) Patent No.: US 9,709,373 B2
(45) Date of Patent: Jul. 18, 2017

(54) WIRELESS DETONATION SYSTEM, WIRELESS DETONATION METHOD, AND DETONATOR AND EXPLOSIVE UNIT USED IN SAME

(71) Applicant: NOF CORPORATION, Tokyo (JP)

(72) Inventors: Satoshi Hikone, Aichi (JP); Yoji Tasaki, Aichi (JP)

(73) Assignee: NOF Corporation, Tokyo (JP)

( * ) Notice: Subject to any disclaimer, the term of this patent is extended or adjusted under 35 U.S.C. 154(b) by 0 days.

(21) Appl. No.: 14/759,531

(22) PCT Filed: Dec. 26, 2013

(86) PCT No.: PCT/JP2013/084923
§ 371 (c)(1),
(2) Date: Jul. 7, 2015

(87) PCT Pub. No.: WO2014/109249
PCT Pub. Date: Jul. 17, 2014

(65) Prior Publication Data

US 2016/0003599 A1 Jan. 7, 2016

(30) Foreign Application Priority Data

Jan. 8, 2013 (JP) ..... 2013-000909

(51) Int. Cl.
*F42C 13/04* (2006.01)
*F42D 1/045* (2006.01)

(52) U.S. Cl.
CPC ..... *F42C 13/04* (2013.01); *F42D 1/045* (2013.01)

(58) Field of Classification Search
CPC ..... F42C 13/04; F42C 13/045; F42C 13/047; F42D 1/045
See application file for complete search history.

(56) References Cited

U.S. PATENT DOCUMENTS 4,451,867 A 5/1984 Robertson
4,860,653 A * 8/1989 Abouav ..... F42B 3/122 102/200

(Continued)

FOREIGN PATENT DOCUMENTS

CN 101655337 A 2/2010
CN 101813442 A 8/2010

(Continued)

OTHER PUBLICATIONS

International Search Report with English translation for PCT/JP2013/084923, mailed Mar. 25, 2014, 4 pgs.

(Continued)

*Primary Examiner* — Stephen M Johnson
(74) *Attorney, Agent, or Firm* — Patterson Thuente Pedersen, P.A.

(57) ABSTRACT

A wireless detonator is provided with: a detonation part; a control part for igniting the detonation part, the control part being connected to the detonation part; a tube for accommodating the detonation part and the control part; and a detonation-side antenna used by the control part for wireless communication and capable of being used for sending and receiving without separately having a transmission-only antenna and a reception-only antenna; the detonation-side antenna being a soft magnetic body coil antenna, and the control part receiving, via the detonation-side antenna, a transmission signal at an operating frequency of 100-500 KHz.

9 Claims, 5 Drawing Sheets

(56) References Cited

U.S. PATENT DOCUMENTS

| | | | | |
|---|---|---|---|---|
| 6,422,145 | B1 | 7/2002 | Gavrilovic et al. | |
| 6,450,817 | B1 * | 9/2002 | Deinlein | F41G 3/26 102/427 |
| 8,070,057 | B2 * | 12/2011 | Jain | G06K 7/10237 235/375 |
| 8,474,379 | B2 * | 7/2013 | Jacobson | F42D 1/05 102/200 |
| 2010/0005994 | A1 | 1/2010 | Jacobson et al. | |
| 2014/0311370 | A1 * | 10/2014 | Koekemoer | F42D 1/055 102/217 |

FOREIGN PATENT DOCUMENTS

| | | | |
|---|---|---|---|
| CN | 101813444 | A | 8/2010 |
| CN | 201666766 | U | 12/2010 |
| JP | 58-66723 | A | 4/1983 |
| JP | 8-219700 | A | 8/1996 |
| JP | H 08-219700 | A | 8/1996 |
| JP | 2001-127511 | A | 5/2001 |
| JP | 2001-153598 | A | 6/2001 |
| JP | 2001-330400 | A | 11/2001 |
| JP | 2001-522981 | A | 11/2001 |

OTHER PUBLICATIONS

Chinese Office Action for Application No. 201380069749.5, mailed Jun. 2, 2016 and English Language Translation (15 pages).
Chinese Search Report for Application No. 201380069749.5, issued May 13, 2016 (2 pages).
Chinese Office Action for application No. 201380069749.5, no mail date indicated, and English Language translation (16 pgs total).
Extended European Search Report for EP Application No. 13871119.7, mailed Jul. 14, 2016 (8 pages).

* cited by examiner

WIRELESS DETONATION SYSTEM, WIRELESS DETONATION METHOD, AND DETONATOR AND EXPLOSIVE UNIT USED IN SAME

RELATED APPLICATIONS

The present application is a National Phase entry of PCT Application No. PCT/JP2013/084923, filed Dec. 26, 2013, which claims priority from JP Patent Application No. 2013-000909, filed Jan. 8, 2013, said applications being hereby incorporated by reference herein in their entirety.

BACKGROUND OF THE INVENTION

The present invention relates to a wireless initiation system, a wireless initiation method, and a detonator and an explosive unit used therein for tunneling.

In the related art, there is a blasting method used for drilling a plurality of blast holes with a diameter of approximately several centimeters and a depth of approximately several meters in a blasting face (which is a tunnel working face) in a boring direction, charging explosives into the blast holes, the blasting of the explosives being able to be wirelessly initiated, wirelessly transmitting an initiation signal from a remote position apart from the blasting face, and exploding the blasting face at a tunnel boring site or the like.

For example, in a signal transmission antenna for a remote wireless initiation system disclosed in JP-A-2001-127511 (Patent Literature 1), a loop antenna of an initiation signal transmitter is disposed close to the entire circumference of a tunnel wall face in such a manner that all of wireless initiating detonators charged into blast holes of a blasting face can stably receive energy even if magnetic energy is small.

In a remote wireless initiation apparatus disclosed in JP-A-2001-153598 (Patent Literature 2), a signal transmitter transmits a control signal requesting a reply signal indicative of a state of charge of electric energy of each wireless detonator, a blast preparation instruction signal is transmitted to each wireless detonator after the completion of the charging of all of the wireless detonators is confirmed, and an initiation signal is transmitted to each wireless detonator after a blast preparation completion signal is received from all of the wireless detonators.

JP-A-2001-330400 (Patent Literature 3) discloses a technology in the related art regarding an antenna, fixedly installed on the ground in a tunnel, for a remote wireless initiation system.

In a signal receiving coil of a wireless detonator disclosed in JP-A-8-219700 (Patent Literature 4), the frequency of the coil is less than or equal to 10 kHz, the number of turns of the coil is 100 turns to 100000 turns, the diameter of the coil is ϕ 35 mm to ϕ 47 mm, and the length of the coil is 5 mm to 300 mm.

BRIEF SUMMARY OF THE INVENTION

In the technology disclosed in Patent Literature 1, since an antenna for signal transmission is wound in a coil shape along the entire circumference of the tunnel side wall multiple times, and the frequency of a signal transmitted from the transmitter is less than or equal to 10 kHz, the number of turns of the antenna is set to be less than or equal to 50 turns, and preferably, to be less than or equal to 30 turns. An extending operation for extending the loop antenna disposed close to the entire circumference of the tunnel side wall while the loop antenna being wound in 30 turns, requires a considerable amount of labor efforts, a large amount of time is required to install the signal transmitting antenna in the vicinity of the blasting face, and rocks in the vicinity of the blasting face may fall or collapse, which is not preferable. A complicated signal receiving coil, obtained by winding a conductive wire around a ferrite core with high magnetic permeability multiple times described later, of the wireless initiating detonator is required in order to receive a signal with a frequency less than or equal to 10 kHz, and draw a large energy. In the signal receiving coil disclosed in Patent Literature 4, the number of turns of the coil is 100 turns to 100000 turns, the diameter of the coil is ϕ 35 mm to ϕ 47 mm, and the length of the coil is 5 mm to 300 mm.

Also in the related art disclosed in Patent Literature 2, since the frequency of a transmission signal from the signal transmitter is less than 10 kHz, similar to Patent Literature 1, an antenna for signal transmission is assumed to be required. Accordingly, similar to Patent Literature 1, a large amount of time is required to perform work in the vicinity of the blasting face, which is not preferable.

A blasting controller and the wireless initiating detonator in the related art disclosed in Patent Literatures 1 to 4 have the following problems.

In order for the wireless initiating detonator to receive a transmission signal wirelessly transmitted from the blasting controller, and to draw a large energy, the energy of a transmission signal from the blasting controller is required to be increased, and the wireless initiating detonator is required to more efficiently receive the transmission signal.

In order for the blasting controller to output a transmission signal with a large energy, it is necessary to increase current to a blasting controller antenna, or to increase the number of turns of the antenna wire. However, when current is increased, current loss associated with Joule heat increases, and in the worst case, the antenna may be burnt out. It is necessary to use a thicker antenna wire with less resistance value, and actually, it is possible to supply only approximately several amperes of current to the antenna. The antenna wire can be realistically wound along an inner wall of the tunnel in at the most approximately 40 turns to approximately 500 turns. Accordingly, as in Patent Literature 1, 40 AT to 500 AT (ampere-turn) is a realistic value which is attainable.

In order for an antenna for signal reception to more efficiently receive a signal, it is necessary to use an antenna with a length close to $\lambda/2$ ($\lambda$ is the wavelength of a transmission signal), to amplify energy drawn by winding the antenna multiple times, and to integrate transmission signals using the core with high magnetic permeability. In the related art disclosed in Patent Literatures 1 to 4, since the frequency of a transmission signal is 10 kHz, $\lambda=v/f=(30*10^7)m/(10*10^3)=30$ km, $\lambda/2=15$ km, and thus the attaching of an antenna with this length to the wireless initiating detonator is not realistic. Therefore, actually, a coil core with substantially the same diameter as that of a cylindrical explosive, obtained by winding a conductive wire around a core with high magnetic permeability and a diameter of approximately 50 mm in several 100 turns to several 100000 turns, is used as an antenna. In this case, the coil core has substantially the same size as that of a baseball, and the weight of the coil core becomes several 100 g, and when the coil core drops out of a blast hole via a lead wire, the lead wire may be cut. Therefore, the dropping of the coil core out of the blast hole is not preferable. Accordingly, as disclosed in Patent Literatures 1 and 4, the core and the signal receiving coil are preferably disposed in a leading portion of the wireless initiating detonator. However, in such case, since the coil core, which is an antenna for signal reception, is disposed at the bottom charge in the blast hole, a transmission signal is unlikely to reach the coil core, and when the frequency is 10 kHz, it is difficult to improve signal receiving efficiency.

As such, in the blasting controller and the wireless initiating detonator assumed from Patent Literature 1 to 4, it is necessary to wind an antenna in approximately 40 turns to approximately 500 turns so as to transmit a transmission signal from the blasting controller, and it is necessary to dispose the coil core, which is an antenna for the wireless initiating detonator to receive the transmission signal, at a bottom charge in the blast hole, and wind the conductive wire in several 100 to several 100000 turns.

In the related art disclosed in Patent Literature 1 to 3, the frequency of a response signal, wirelessly transmitted from the wireless initiating detonator to the blasting controller, is 10 MHz to 60 MHz. Here, when the frequency of the response signal is 10 MHz, the length of the blasting controller antenna with the best signal receiving efficiency is $\lambda/2=[(30*10^7)/(10*10^6)]/2=15$ m. When the antenna with a length longer than $\lambda$ is used, standing waves are likely to occur, which is not preferable. As described above, the antenna for receiving the transmission signal from the blasting controller is wound along the side wall of the tunnel in 40 turns to 500 turns, and the length of the antenna easily exceeds $\lambda$ (in this case, 30 m). Accordingly, as disclosed in Patent Literature 3, it is necessary to configure the blasting controller antenna for receiving the response signal as a half-wavelength dipole antenna only for signal reception. When the aforementioned coil core is used to transmit a response signal from the wireless initiating detonator, the response signal is transmitted from the bottom charge in a blast hole, and a considerably small energy reaches the blasting controller. In the wireless initiating detonator disclosed in Patent Literature 3, the wire-like antenna only for transmitting a response signal drops out of a blast hole.

As such, with regard to the blasting controller and the wireless initiating detonator assumed from the related art disclosed in Patent Literatures 1 to 4, it is necessary to provide a large coil core as an antenna only for signal reception and a wire-like antenna as an antenna only for signal transmission in the wireless initiating detonator. In the blasting controller, an antenna only for signal transmission is required to be wound along the side wall of the tunnel in 40 turns to 500 turns, and a dipole antenna only for signal reception is needed. Accordingly, an amount of time is taken to set up an antenna for the blasting controller, and a large amount of time is taken to perform work in the vicinity of the blasting face, which are not preferable.

According to an aspect of the present invention, there is provided a wireless initiating detonator including: an initiator; a controller connected to the initiator, and configured to ignite the initiator; a shell configured to accommodate the initiator and the controller; and a detonator antenna used by the controller for wireless communication, and useable for both signal transmission and signal reception without an antenna only for signal transmission and an antenna only for signal reception being separately provided. The detonator antenna is a soft magnetic coil antenna. The controller receives a transmission signal with an operation frequency via the detonator antenna, the operation frequency being a frequency which is greater than or equal to 100 kHz and is less than or equal to 500 kHz.

Due to this configuration, since the frequency of a signal wirelessly received by the wireless initiating detonator is set to be greater than or equal to 100 kHz, and to be less than or equal to 500 kHz, it is possible to use the soft magnetic coil antenna, obtained by winding a conductive wire around a soft magnetic material in several turns to several tens of turns, as the detonator antenna.

Accordingly, it is possible to use a small soft magnetic coil antenna with a very simple structure, to reduce the diameter of the detonator antenna to a size smaller than an inner diameter of a blast hole, and to charge the wireless initiating detonator into the blast hole while the detonator antenna is connected to the wireless initiating detonator. Therefore, it is possible to reduce an amount of time required to charge the wireless initiating detonator into the blast hole of a blasting face. As a result, it is possible to further reduce an amount of time required to perform work in the vicinity of the blasting face.

The soft magnetic material is a material with a high magnetic permeability, the magnetic poles of which are relatively easily eliminated or reversed among magnetic materials. The soft magnetic material includes, for example, iron, silicon steel, permalloy, sendust, permendur, ferrite, an amorphous magnetic alloy, a nanocrystalline magnetic alloy, or the like, and typically, ferrite is used.

It is possible to easily set the orientation of the detonator antenna along the axial direction of the blast hole by using the soft magnetic coil antenna as the detonator antenna. Accordingly, it is not necessary to adjust the orientation of each detonator antenna, and it is possible to further reduce an amount of time required to perform work in the vicinity of the blasting face.

In the wireless initiating detonator according to the above aspect, the detonator antenna may be installed on the axis of a shell while being in contact with the shell, or may be installed around the shell while being in contact with the shell. It is possible to install the detonator antenna at an appropriate position. Since the shell is integrated with the detonator antenna, it is possible to further reduce an amount of time required to charge the wireless initiating detonator into the blast hole of the blasting face.

In the wireless initiating detonator according to the above aspect, the detonator antenna may be located in such a manner as to be oriented in a predetermined direction via a leading wire without being in contact with the shell. It is possible to increase a degree of freedom in the installation of the detonator antenna. For example, even if the wireless initiating detonator is installed at a bottom in a blast hole, it is possible to install the detonator antenna in an entrance portion of the blast hole, which is convenient. In this case, the detonator antenna can be adjusted such that the detonator antenna is oriented in a direction (a predetermined direction) in which the detonator antenna can satisfactorily perform the wireless supply of electric power and wireless communication.

In the wireless initiating detonator according to the above aspect, a display device is attached to the wireless initiating detonator directly or via a cable, and displays individual pieces of information by which the wireless initiating detonator can be identified. It is possible to confirm the individual pieces of information regarding the wireless initiating detonator via the display device. Accordingly, it is possible to identify a malfunctioned wireless initiating detonator.

According to another aspect of the present invention, there is provided an explosive unit that includes the wireless initiating detonator according to the above aspect, and a primary charge which is an explosive, wherein the wireless initiating detonator is attached to the primary charge, wherein when the display device is attached to the wireless initiating detonator via the cable, the length of the cable is set to a length such that the display device can reach the outside of the blast hole when the explosive unit is charged into a blast hole. Accordingly, the explosive unit can be appropriately configured.

When the display device is attached to the wireless initiating detonator via the cable, the display device, displaying the individual information, sticks out of the blast hole. Therefore, when a malfunction occurs with the wireless initiating detonator, an operator can easily identify the malfunctioned wireless initiating detonator without taking it out of the blast hole.

According to still another aspect of the present invention, there is provided a wireless initiation system including: the explosive unit according to the above aspect; a blasting controller disposed at a remote position away from the blast hole, and configured to be able to wirelessly transmit the transmission signal to the wireless initiating detonator and to wirelessly receive a response signal from the wireless initiating detonator; and a blasting controller antenna used by the blasting controller for wireless communication, and useable for both signal transmission and signal reception without an antenna only for signal transmission and an antenna only for signal reception being separately provided.

The blasting controller antenna has a substantial loop shape. When the controller receives the transmission signal from the blasting controller, the controller prepares a response signal corresponding to the received transmission signal, and transmits the prepared response signal with a response frequency higher than the operation frequency via the detonator antenna. The response frequency is set to a frequency corresponding to a wavelength longer than the loop length of the blasting controller antenna.

Due to this configuration, since the frequency of a signal transmitted from the blasting controller to the wireless initiating detonator is set to be greater than or equal to 100 kHz, and to be less than or equal to 500 kHz, it is possible to reduce the number of turns of the blasting controller antenna to less than or equal to 1/10 of that when the frequency is set to be 10 kHz. Accordingly, it is possible to further reduce an amount of time required to extend the blasting controller antenna in the vicinity of the blasting face. Therefore, it is possible to further reduce an amount of time required to perform work in the vicinity of the blasting face. Since the response frequency of a signal from the wireless initiating detonator is set to a frequency corresponding to a wavelength longer than the length of the blasting controller antenna, it is possible to prevent the occurrence of standing waves, and to improve the reliability of signal transmission and signal reception. Here, the loop length of the blasting controller antenna refers to the total extension length of the blasting controller antenna wound in a substantial loop shape.

In the wireless initiation system according to the above aspect, it is preferred that the response frequency may exceed the operation frequency, and is less than or equal to 10 MHz. Accordingly, it is possible to set an appropriate response frequency such that the occurrence of standing waves can be prevented, and to improve the reliability of signal transmission and signal reception.

According to still another aspect of the present invention, there is provided a wireless initiation method for blasting using the above-mentioned explosive unit, and the blasting controller configured to wirelessly transmit a transmission signal to the wireless initiating detonator and to wirelessly receive a response signal from the wireless initiating detonator. The method includes: a step of drilling the blast hole in the blasting face; a step of charging the explosive unit into the blast hole; a step of extending the blasting controller antenna in a substantial loop shape at a position away from the blasting face at a predetermined distance, the blasting controller antenna being used by the blasting controller for wireless communication, and the length of the blasting controller antenna being set to a length shorter than a wavelength corresponding to the response frequency of the response signal; a step of transmitting a preparation start signal with an operation frequency, greater than or equal to 100 kHz, and less than or equal to 500 kHz, from the blasting controller via the blasting controller antenna, the preparation start transmission signal causing the wireless initiating detonator to prepare for initiation; a step of starting the preparation of initiation using the controller when the preparation start signal is received via the detonator antenna; a step of transmitting a preparation completion signal with the response frequency, exceeding the operation frequency corresponding to a wavelength longer than the length of the blasting controller antenna, and less than or equal to 10 MHz, from the controller to the blasting controller via the detonator antenna when preparation is completed, the preparation completion signal being a response signal indicative of the completion of preparation; a step of transmitting an initiation execution signal, which is a transmission signal indicative of the execution of initiation, from the blasting controller when the preparation completion signal is received via the blasting controller antenna; and a step of igniting the initiating explosives and initiating the blasting of the primary charge using the controller when the initiation execution signal is received via the detonator antenna.

Due to this configuration, since the operation frequency of a signal transmitted from the blasting controller to the wireless initiating detonator is set to be greater than or equal to 100 kHz, and to be less than or equal to 500 kHz, and the soft magnetic coil antenna is used as the detonator antenna, it is possible to realize the wireless initiation method by which it is possible to further reduce an amount of time required to perform work in the vicinity of the blasting face, that is, an amount of time for adjusting the directivity of the detonator antenna, for the charging step, and for the blasting controller antenna extending step.

In the wireless initiation method according to the above aspect, when the display device is attached to the wireless initiating detonator via the cable with a length such that the display device can reach the outside of the blast hole, the primary charge may be charged into the blast hole in such a manner that the display device can reach the outside of the blast hole. Accordingly, when a malfunction occurs with a wireless initiating detonator, an operator can easily identify the malfunctioned wireless initiating detonator by comparing individual pieces of information (for example, an initiation delay time or an identification number) displayed on the blasting controller with individual pieces of information displayed on the display device that drops out of the blast hole. Accordingly, it is possible to further reduce an amount of time required to perform work in the vicinity of the blasting face after the wireless initiating detonators are charged into the blast holes.

DETAILED DESCRIPTION OF THE INVENTION

Hereinafter, various examples of the present invention, used at a tunnel excavation site, will be described with reference to the accompanying drawings.

Figure 1:
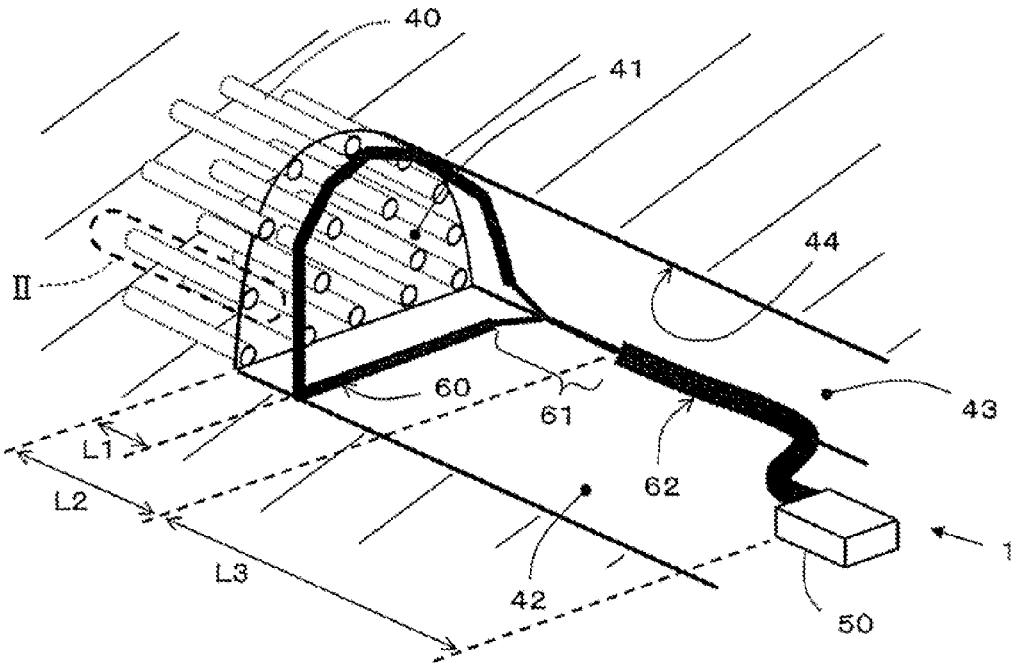
FIG. 1 is a view illustrating a wireless blast initiation system 1 used for exploding a blasting face 41 at a tunnel excavation site.

[Entire Configuration (FIG. 1) of Wireless Initiation System and State (FIG. 2) of Charging of Explosive Unit Into Blast Hole]

A wireless initiation system 1 is formed of an explosive unit 20 charged into a blast hole 40 that is drilled into a blasting face 41; a blasting controller 50 that is disposed at a remote position away from the blast hole 40, and can wirelessly transmit and receive signals to and from the explosive unit 20; a blasting controller antenna 60 that extends in the vicinity of the blasting face 41.

For example, the blast hole 40 is a hole drilled with a diameter D1 of approximately 5 cm and a depth D2 of approximately 2 m, and the blast hole 40 is not limited to a specific size.

Figure 3:
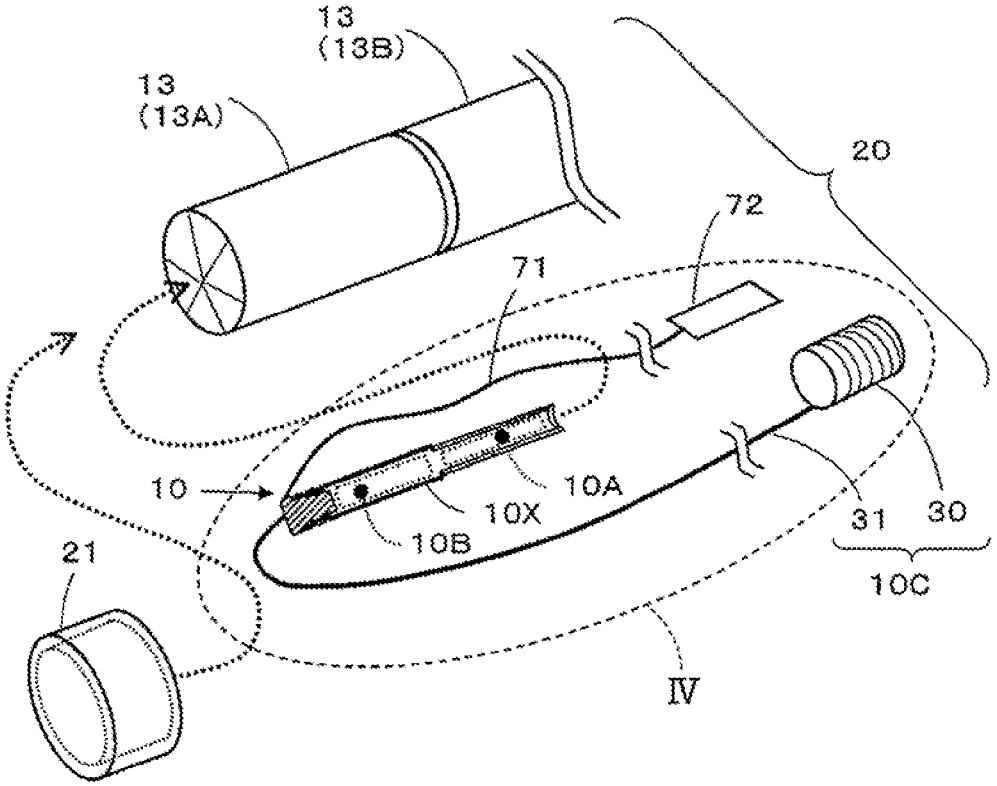
FIG. 3 is a view illustrating an example of the structure of the explosive unit 20.
Figure 4:
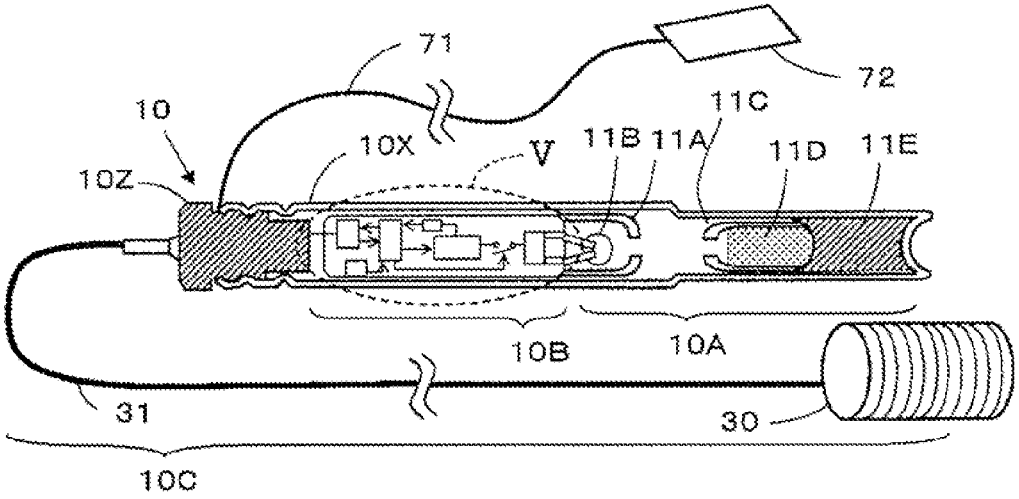
FIG. 4 is a view illustrating an example of the structure of a wireless initiating detonator 10 illustrating Part IV in FIG. 3.

As illustrated in FIGS. 3 and 4, a wireless initiating detonator 10 is formed of an initiator 10A; a controller 10B; a shell 10X that accommodates the initiator 10A and the controller 10B; and an antenna unit 10C. The antenna unit 10C is formed of a substantially loop-like detonator antenna 30, and a leading wire 31, one end of which is connected to the controller 10B and the other end is connected to the detonator antenna 30. The wireless initiating detonator 10 is charged into the blast hole 40 along with a primary charge 13A which is a foremost explosive 13 charged into the blast hole 40, and into which the wireless initiating detonator 10 is inserted, and secondary charges 13B that are explosives 13, the quantity of which is appropriately increased or decreased unlike the primary charge 13A.

Figure 2:
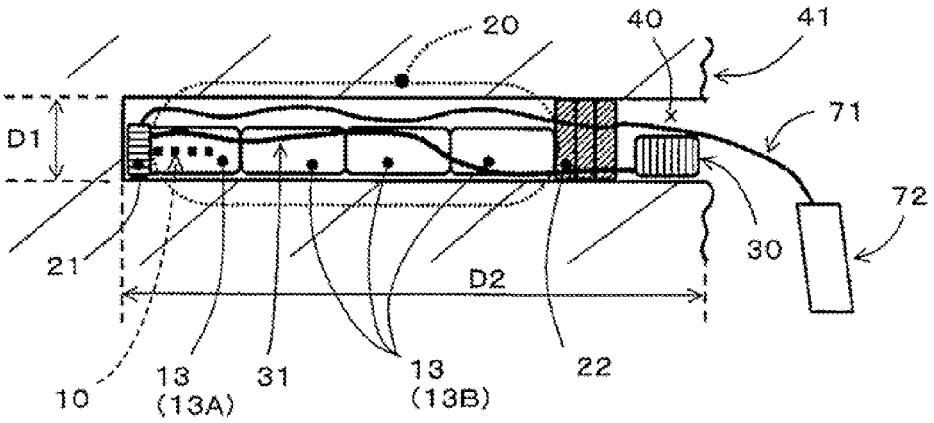
FIG. 2 is a view illustrating a state in which an explosive unit 20 is charged into a blast hole 40 drilled into the blasting face 41 illustrated in Part II in FIG. 1.
Figure 7:
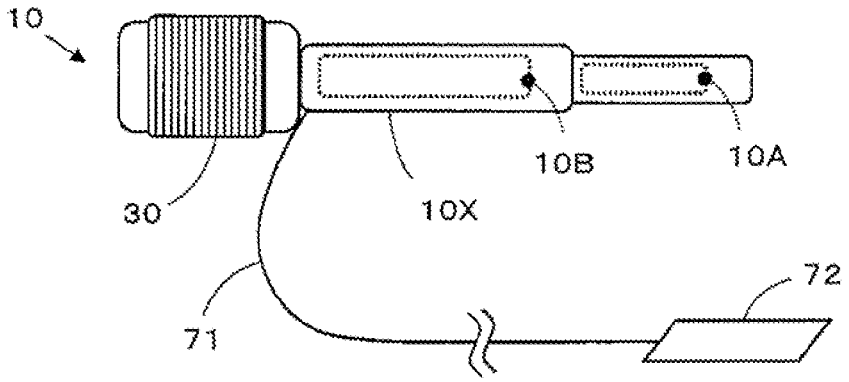
FIG. 7 is a view illustrating an example of the disposition of a detonator antenna relative to a shell that accommodates an initiator and the controller.
Figure 8:
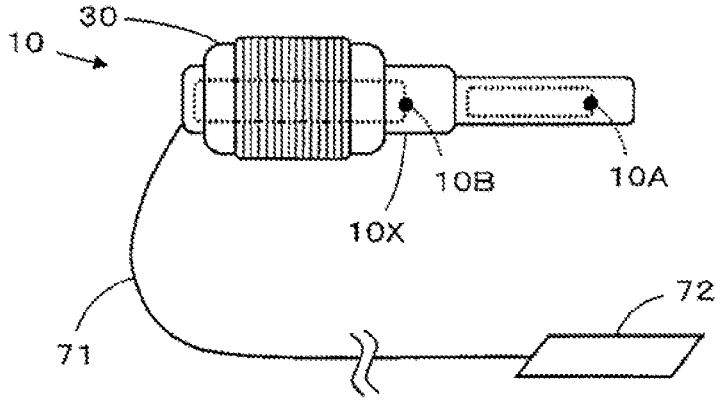
FIG. 8 is a view illustrating another example of the disposition of the detonator antenna.

As illustrated in FIG. 3, the explosive unit 20 is formed of the explosives 13 and the wireless initiating detonator 10, and the explosive unit 20 may include only the primary charge 13A, or the secondary charges 13B in addition to the primary charge 13A. As illustrated in FIG. 2, the explosive unit 20 is charged into the blast hole 40 while a protective cap 21, made of an elastic material such as rubber, is fitted to a leading end of the explosive unit 20, and a trailing end of the explosive unit 20 is covered with a tamping material 22 such as clay. The length of the leading wire 31 may be set to a length such that the detonator antenna 30 can reach the outside of the blast hole 40 when the explosive unit 20 is charged into the blast hole 40, or as illustrated in FIG. 2, the length of the leading wire 31 may be set to a length such that the detonator antenna 30 can be disposed in the blast hole 40. Alternatively, as illustrated in FIGS. 7 and 8, without the leading wire 31, the detonator antenna 30 may be disposed on the axis of the shell 10X while being in contact with the shell 10X, or may be wound around the shell 10X while being in contact with the shell 10X. The protective cap 21 works to protect the leading wire 31, and to reduce shocking to the explosive unit 20 when being charged; however, the protective cap 21 may be omitted.

A display device 72 displays individual pieces of information (for example, a blast initiation delay time or an identification number) by which an operator can identify the wireless initiating detonator 10, and is attached to the wireless initiating detonator 10 via a cable 71. The length of the cable 71 is set to a length such that the display device 72 can reach the outside of the blast hole 40 when the primary charge 13A is charged into the blast hole 40. Accordingly, as illustrated in FIG. 2, when the primary charge 13A is charged into the blast hole 40, the display device 72 is disposed outside of the blast hole 40. The cable 71 and the display device 72 may be omitted.

The blasting controller antenna 60 is connected to the blasting controller 50 via a firing cable 62 and a connecting cable 61. A new blasting controller antenna 60 and a new connecting cable 61 are extended with each blasting. The blasting controller antenna 60 extends along a tunnel floor 42, a tunnel side wall 43, and a tunnel ceiling 44 at a position apart from the blasting face 41 by a distance L1 of approximately 1 m or the like. For example, a distance L2 between a leading end of the firing cable 62 and the blasting face 41 is approximately 30 m. For example, a distance L3 between the leading end of the firing cable 62 and the blasting controller 50 is approximately 70 m.

The blasting controller 50 wirelessly transmits a transmission signal via the firing cable 62, the connecting cable 61, and the blasting controller antenna 60, and an operation frequency, which is the frequency of the transmission signal, is greater than or equal to 100 kHz, and is less than or equal to 500 kHz. When the operation frequency is greater than 500 kHz, standing waves are likely to occur in a tunnel, and an operation frequency greater than 500 kHz is not preferable.

The blasting controller 50 receives a response signal from the controller 10B of the wireless initiating detonator 10 via the blasting controller antenna 60, the connecting cable 61, and the firing cable 62. A response frequency, which is the frequency of the response signal from the wireless initiating detonator 10, exceeds the operation frequency, and is 10 MHz.

As one example, it is possible to limit the number of turns of the blasting controller antenna 60 to one turn or approximately several turns by setting the operation frequency to a frequency which is greater than or equal to 100 kHz and is less than or equal to 500 kHz. Electric power is supplied to the controller 10B of the wireless initiating detonator 10, and ignition energy is stored via the transmission signal with the operation frequency. The transmitted electric power for the supply of electric power to the controller 10B and the storage of electric power can be a relatively small electric power of approximately several tens of W to approximately several hundreds of W. It is possible to configure the detonator antenna 30 as one soft magnetic coil antenna for signal transmission and reception without separately preparing an antenna only for signal transmission and an antenna only for signal reception. It is possible to reduce the diameter of the detonator antenna 30 to a size smaller than equal to that of the blast hole.

For example, when the operation frequency is 200 kHz, $\lambda/2$ is equal to 750 m ($\lambda/2=[v/f]/2=[(30*10^7)/(200*10^3)]/2$), wherein $\lambda/2$ is the length of the detonator antenna such that the wireless initiating detonator can receive a signal most efficiently; however, a very light and small soft magnetic coil antenna can draw sufficient energy, the soft magnetic coil antenna being obtained by winding a conductive wire around a soft magnetic material in approximately several tens of turns. The soft magnetic material is a material with a high magnetic permeability, the magnetic poles of which are relatively easily eliminated or reversed among magnetic materials. The soft magnetic material may be iron, silicon steel, permalloy, sendust, permendur, ferrite, an amorphous magnetic alloy, a nanocrystalline magnetic alloy, or the like, and typically, ferrite is used as the soft magnetic material.

The soft magnetic coil antenna as one example of the detonator antenna 30 can very efficiently draw energy compared to that in the related art. Since the operation frequency is high, a wavelength $\lambda$ is short compared to that in the related art, and the detonator antenna 30 easily draws energy. Since the wireless initiating detonator has a good signal receiving efficiency, an output energy of the transmission signal is not required to be as high as that in the related art, and one to approximately several turns of the blasting controller antenna may be used.

The soft magnetic coil antenna in the blast hole can be used in common as a transmission antenna for transmitting a response signal from the wireless initiating detonator to the blasting controller. When the response frequency is 10 MHz, the length of a signal receiving antenna of the blasting controller is preferably set not to exceed the wavelength $\lambda$ (in this case, 30 m) of the response frequency, and one to several turns of the blasting controller antenna can be used in common as the signal receiving antenna.

In a method in the related art in which the operation frequency is less than or equal to 10 kHz, as described above, it is necessary to wind the blasting controller antenna for transmitting a transmission signal in approximately 40 turns to approximately 500 turns, a dipole antenna for receiving a response signal from the wireless initiating detonator is needed, and a considerably large amount of time is required to perform work in the vicinity of the blasting face. In the example of the present invention, since the winding of the blasting controller antenna 60 in one turn to approximately several turns is good enough, and the dipole antenna only for signal reception is not needed, it is possible to end an extending operation for extending the blasting controller antenna 60 in the vicinity of the blasting face in a very short amount of time compared to that in the related art.

In the method in the related art in which the operation frequency is less than or equal to 10 kHz, as described above, it is necessary to dispose a complicated and heavy element, obtained by winding a conductive wire around a ferrite core with a diameter of approximately 50 mm multiple times, at the bottom in the blast hole, and to drop a wire-like antenna out of the blast hole. In the example of the present invention, it is good enough only to insert the wireless initiating detonator into an explosive which is the primary charge, a very light and small ferrite rod antenna (obtained by winding a conductive wire around a ferrite rod in approximately several tens of turns) as the soft magnetic coil antenna being attached to the wireless initiating detonator, and only to insert the primary charge into the blast hole. In addition, in the example, since it is possible to limit the diameter of the detonator antenna 30 to a diameter smaller than or equal to that of the blast hole, it is possible to set the wireless initiating detonator 10, to which the detonator antenna is attached, in a charging apparatus without being disturbed. As a result, it is possible to end a charging operation for charging the wireless initiating detonator 10 into the blast hole 40 in a shorter time.

[Structure (FIGS. 3 to 5) of Wireless Initiating Detonator and Process Sequence (FIGS. 6A and 6B) of Wireless Initiation Method]

Figure 5:
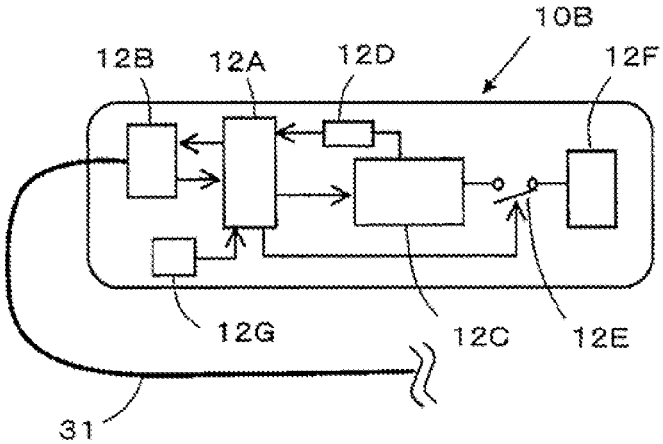
FIG. 5 is a view illustrating an example of the structure of a controller 10B illustrated in Part V in FIG. 4.

Subsequently, the structure of the wireless initiating detonator 10 will be described in detail with reference to FIGS. 3 to 5. The leading explosive 13 from the explosives charged into the blast holes 40 is the primary charge 13A into which the wireless initiating detonator 10 is inserted, and which is directly exploded by the wireless initiating detonator 10. The explosive 13, disposed behind the primary charge 13A from the explosives charged into the blast holes 40, is the secondary charge 13B that is exploded in connection with the explosion of the primary charge 13A. The number of secondary charges 13B is appropriately increased or decreased based on a desirable blasting energy.

FIG. 4 illustrates a sectional view of the wireless initiating detonator 10, and the wireless initiating detonator 10 is configured such that the shell 10X accommodates the initiator 10A and the controller 10B, and is sealed with a plug 10Z. The initiator 10A has an insulating sleeve 11A, a fuse head 11B, an inner tube 11C, a primary explosive 11D, a base charge 11E, and the like. The controller 10B has a signal transmission and reception unit 12B, a CPU 12A, an electric power storage unit 12C, an electric power charging state detector 12D, a switch 12E, an igniter 12F, an ID storage unit 12G, and the like.

Hereinafter, an operation of each configuration element of the controller 10B will be described with reference to the flowchart illustrated in FIGS. 6A and 6B. A description hereinbelow will be given on the condition that the operation frequency, which is a frequency of a transmission signal from the blasting controller 50, is set to 200 kHz, and the response frequency, which is a frequency of a response signal from the wireless initiating detonator 10, is set to 10 MHz.

Figures 6A, 6B:
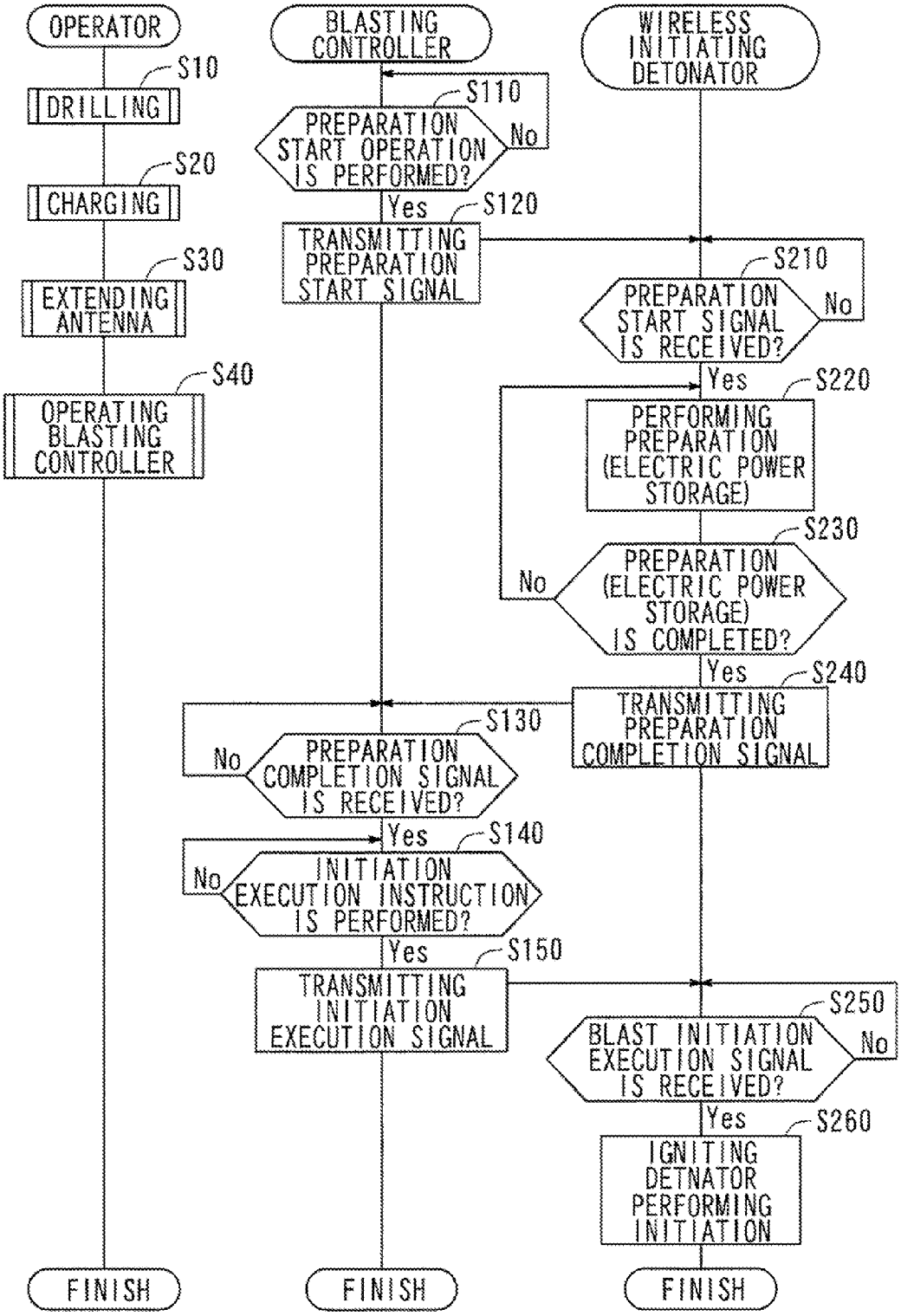
FIG. 6A is a flowchart illustrating a part of a process sequence of a wireless initiation method.
FIG. 6B is a flowchart illustrating another part of the process sequence of the wireless initiation method.

As illustrated in FIGS. 6A and 6B, in a blast hole drilling step illustrated in step S10, an operator drills a plurality of the blast holes 40 in the blasting face 41 using a hole drilling machine or the like, and the procedure proceeds to step S20.

In a charging step illustrated in step S20, the operator charges the explosive unit 20 into each of the drilled blast holes 40 using a charging apparatus or the like such that the detonator antenna 30 is positioned in an entrance portion of the blast hole 40 while being oriented so as to be able to efficiently transmit and receive signals, and the procedure proceeds to step S30. In the description above, the detonator antenna is disposed in the entrance portion of the blast hole; however, the position of the detonator antenna is not limited to the entrance portion of the blast hole, and it is possible to dispose the detonator antenna at an arbitrary position in the blast hole.

When the cable 71 and the display device 72 are provided, in the charging step, the operator charges the explosive unit 20 including the primary charge into the blast hole 40 such that the display device 72 reaches the outside of the blast hole 40, and the procedure proceeds to step S30. When the operator charges the explosive unit including the primary charge into the blast hole, the length of the cable 71 is set to a length such that the display device can reach the outside of the blast hole.

In a blasting controller antenna extending step illustrated in step S30, the operator extends the blasting controller antenna 60 along the tunnel floor, the tunnel side wall, and the tunnel ceiling at a position apart from the blasting face 41 by the distance L1, and connects together the blasting controller antenna 60, the connecting cable 61, the firing cable 62, and the blasting controller 50, and the procedure proceeds to step S40. The length of the blasting controller antenna 60 is set to a length shorter than a wavelength corresponding to the response frequency of the wireless initiating detonator 10, that is, the response frequency is set to a frequency corresponding to a wavelength longer than a loop length of the blasting controller antenna. The loop length of the blasting controller antenna refers to the total extension length of the blasting controller antenna wound in a loop shape.

For example, when the response frequency is 10 MHz, a wavelength is 30 m (=300000 (km/s)/$10*10^6$ (1/s) according to $\lambda=v/f$ (wavelength=light velocity/response frequency). When the response frequency is 10 MHz, the blasting controller antenna 60 with a length less than 30 m extends in a substantial loop shape. Accordingly, it is possible to prevent the occurrence of standing waves, and to improve the reliability of wireless communication. Since the blasting controller antenna 60 with this length can extend on the entire circumference of the tunnel when being wound along the tunnel floor, the tunnel side wall, and the tunnel ceiling only in one turn or several turns, it is possible to complete the blasting controller antenna extending operation in a very short amount of time. The length of the blasting controller antenna 60 may be determined after the response frequency is determined Alternatively, the response frequency may be determined after the length of the blasting controller antenna 60 is determined In step S40, the operator starts to operate the blasting controller 50. Hereinafter, an operation of the blasting controller 50 and an operation of the controller 10B of the wireless initiating detonator 10 in association with the operation illustrated in step S40 performed by the operator will be described.

In step S110, the blasting controller 50 determines whether the operator inputs an instruction indicative of transmitting a preparation start signal causing all the wireless initiating detonators 10 to start initiation preparation. When the instruction is input from the operator (Yes), the procedure proceeds to step S120, and when the instruction is not input from the operator (No), the procedure returns to step S110, and the blasting controller 50 waits for an input.

When the procedure proceeds to step S120, the blasting controller 50 wirelessly transmits a preparation start signal with the response frequency (in this case, 200 kHz) via the firing cable 62, the connecting cable 61, and the blasting controller antenna 60, and the procedure proceeds to step S130.

A preparation start signal transmitting step can include step S110 and step S120.

In step S210, the CPU 12A of the controller 10B of the wireless initiating detonator 10 determines whether the wireless initiating detonator 10 has received the preparation start signal from the blasting controller 50. When the wireless initiating detonator 10 has received the preparation start signal (Yes), the procedure proceeds to step S220, and when the wireless initiating detonator 10 has not received the preparation start signal (No), the procedure returns to step S210, and the wireless initiating detonator 10 waits for an input. In this case, the signal transmission and reception unit 12B in FIG. 5 detects a transmission signal (in this case, the preparation start signal) directly input from the detonator antenna 30, or input from the blasting controller 50 via the detonator antenna 30 and the leading wire 31, and outputs the detected transmission signal to the CPU 12A. The signal transmission and reception unit 12B converts the received signal with the response frequency (in this case, 200 kHz) into electric power, and supplies electric power for use in the controller 10B, and electric power charged into the electric power storage unit 12C.

When the procedure proceeds to step S220, the CPU 12A causes the electric power storage unit 12C to start to store electric power for preparation of initiation, based on the received preparation start signal, and the procedure proceeds to step S230. The electric power storage unit 12C is a capacitor or the like, and can store electrical charge based on a control signal from the CPU 12A. The CPU 12A can detect a state of charge of electrical power of the electrical power storage unit 12C via the electrical power charging state detector 12D.

In step S230, the CPU 12A determines whether a state of charge of the electrical power storage unit 12C has reached a pre-set state of charge based on a detection signal from the electrical power charging state detector 12D. When the state of charge has reached the set state of charge (Yes), the procedure proceeds to step S240, and when the state of charge has not reached the set state of charge (No), the procedure proceeds to step S220.

When the procedure proceeds to step S240, the CPU 12A outputs a preparation completion signal to the signal transmission and reception unit 12B, the preparation completion signal being a response signal including information indicative of the completion of preparation (of charge), and the procedure proceeds to step S250. The preparation completion signal includes ID information read from the ID storage unit 12G. The blasting controller 50 can appropriately recognize a wireless initiating detonator, the preparation (of charge) of which is completed, using the ID information (ID uniquely pre-assigned to each of the controllers 10B). The signal transmission and reception unit 12B outputs a response signal with the response frequency (in this case, 10 MHz) from the CPU 12A to the blasting controller 50 via the leading wire 31 and the detonator antenna 30.

A preparation completion response step can include steps S210 to S240.

In step S130, the blasting controller 50 determines whether the blasting controller 50 has received the preparation completion signal from the wireless initiating detonator 10. A unique ID is pre-assigned to each of the plurality of wireless initiating detonators 10, and the preparation completion signal includes ID information. The blasting controller 50 determines whether the blasting controller 50 has received the preparation completion signals from all the wireless initiating detonators. When the blasting controller 50 has received the preparation completion signals from all the wireless initiating detonators 10 (Yes), the procedure proceeds to step S140, and when the blasting controller 50 has not received the preparation completion signals from all the wireless initiating detonators 10 (No), the procedure returns to step S130, and the blasting controller 50 waits until receiving the preparation completion signals from all the wireless initiating detonators 10. When the blasting controller 50 does not receive the preparation completion signals from all the wireless initiating detonators 10 even after a predetermined amount of time has elapsed, the operator takes an action for interruption or the like which is not illustrated.

When the procedure proceeds to step S140, the blasting controller 50 determines whether the operator inputs an instruction indicative of the execution of initiation. When the operator inputs the instruction indicative of the execution of initiation (Yes), the procedure proceeds to step S150, and when the operator does not input the instruction (No), the procedure returns to step S140, and the blasting controller 50 waits for an input.

When the procedure proceeds to step S150, the blasting controller 50 transmits an initiation execution signal with the operation frequency via the firing cable 62, the connecting cable 61, and the blasting controller antenna 60, the initiation execution signal being a transmission signal indicative of the execution of initiation.

An initiation execution signal transmitting step can include steps S130 to S150.

In step S250, the CPU 12A of each of the wireless initiating detonators 10 determines whether the CPU 12A has received the initiation execution signal. In this case, the signal transmission and reception unit 12B detects a transmission signal (in this case, the initiation execution signal) directly input from the detonator antenna 30, or input from the blasting controller 50 via the detonator antenna 30 and the leading wire 31, and outputs the detected transmission signal to the CPU 12A. The CPU 12A determines whether a signal input from the signal transmission and reception unit is the initiation execution signal. When the CPU 12A has received the initiation execution signal (Yes), the procedure proceeds to step S260, and when the CPU 12A has not received the initiation execution signal (No), the procedure returns to step S250, and the CPU 12A waits until the initiation execution signal is transmitted. When the initiation execution signal is not transmitted even after a predetermined amount of time has elapsed, the CPU 12A determines that this event is timed out, causes the electrical power storage unit 12C to dissipate charged energy, and ends the process.

When the procedure proceeds to step S260, the CPU 12A ignites the initiator 10A and initiates the detonator 10. In this case, the CPU 12A supplies energy charged into the electrical power storage unit 12C to the igniter 12F by operating the switch 12E, ignites the initiator 10A, and initiates the primary charge 13A and the secondary charges 13B.

Figure 9:
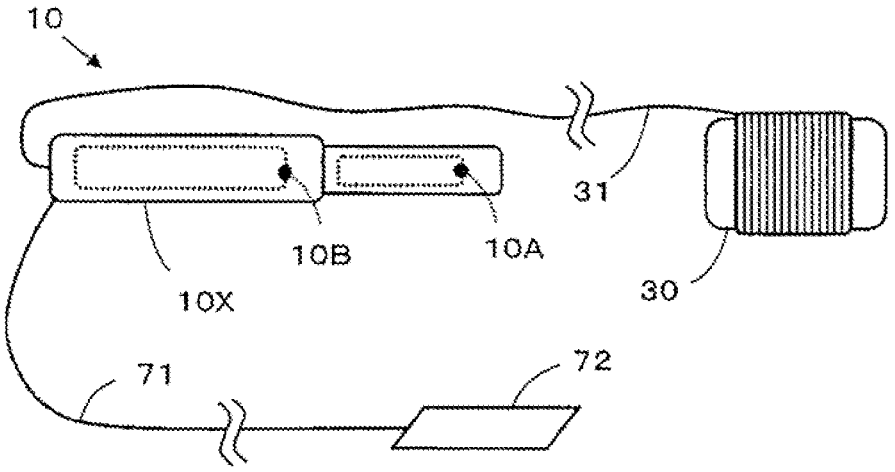
FIG. 9 is a view illustrating still another example of the disposition of the detonator antenna.

In the example of the wireless initiation system described above with reference to FIGS. 1 to 5, the frequency of a signal transmitted from the blasting controller 50 is set to be greater than or equal to 100 kHz, and to be less than and equal to 500 kHz, and thus it is possible to configure the detonator antenna 30 as a light, small, and soft magnetic coil antenna made of a soft magnetic material, and to reduce the diameter of the detonator antenna 30 to a size smaller than or equal to that of the blast hole. Accordingly, it is possible to install the detonator antenna at an arbitrary position in the blast hole, or to drop the detonator antenna out of the blast hole. As illustrated in FIGS. 7 to 9, when the wireless initiating detonator 10 is charged into the blast hole while being attached to the explosive 13, the detonator antenna 30 is disposed on the axis of the shell 10X while being in contact with the shell 10X (refer to FIG. 7) that accommodates the initiator 10A and the controller 10B of the wireless initiating detonator 10, is wound around the shell 10X while being in contact with the shell 10X (refer to FIG. 8), or is installed in the blast hole at a remote position via the leading wire while not being in contact with the shell 10X, and being oriented in a predetermined direction (direction in which the detonator antenna 30 can efficiently transmit and receive signals, and can satisfactorily perform the wireless supply of electric power and wireless communication).

Accordingly, it is possible to easily set the orientation of the detonator antenna 30 along the axial direction of the blast hole. As a result, when the detonator antenna drops out of the blast hole, it is not necessary to adjust the orientation of each detonator antenna. Accordingly, it is possible to further reduce an amount of time required to perform work in the vicinity of the blasting face. The detonator antenna 30 may drop out of the blast hole.

The soft magnetic coil antenna can receive a transmission signal and transmit a response signal, and as in the related art, an antenna only for transmission signal reception and an antenna only for response signal transmission are not needed. Accordingly, it is possible to further reduce an amount of time required to charge the primary charge 13A with the wireless initiation detonator 10 into the blast hole 40.

It is good enough to set the frequency of a response signal from the wireless initiating detonator 10 to a frequency which is greater than or equal to 1 MHz and is less than or equal to 10 MHz, and it is good enough to set the length of the blasting controller antenna 60 to a length such that the blasting controller antenna 60 can be wound along the tunnel floor, the tunnel side wall, and the tunnel ceiling in one turn or approximately several turns. The blasting controller antenna 60 can transmit a transmission signal and receive a response signal, and as in the related art, an antenna only for transmission signal transmission and a dipole antenna only for response signal reception are not needed. Accordingly, it is also possible to further reduce an amount of time required to extend the blasting controller antenna.

Since blasting may cause the occurrence of invisible internal damage in the blasting controller antenna 60, for reasons of safety, the blasting controller antenna 60 re-extends every blasting. For this reason, it is possible to reduce a considerable amount of time required to extend the blasting controller antenna 60, wound simply in one turn or several turns in this application, from that required to extend 40 turns to 500 turns of the antenna and the dipole antenna in the related art, and it is possible to improve the safety of a blasting operation.

In the example of the wireless initiation method described with reference to FIGS. 6A and 6B, it is possible to further reduce an amount of time required to perform work in the vicinity of the blasting face, and it is possible to explode the blasting face more safely.

When a malfunction occurs with a wireless initiating detonator after being charged into the blast hole, since the display device is attached to the wireless initiating detonator, and sticks out of the blast hole, the operator can easily identify the malfunctioned wireless initiating detonator by comparing individual pieces of information (regarding the malfunctioned wireless initiating detonator) displayed on the blasting controller with individual pieces of information displayed on the display device that drops out of the blast hole. Therefore, the operator can further reduce working hours.

Various examples of the present invention have be specifically described; however, it is apparent to persons skilled in the art that the appearance, structure, configuration, and process in the wireless initiation system, the wireless initiation method, the wireless initiating detonator, and the explosive unit are not limited to those in the examples described herein, and modifications, additions, and removals can be made to the examples in various forms insofar as the modifications, additions, and removals do not depart from the scope of the present invention.

The use of the aforementioned wireless blast initiation system and wireless initiation method is not limited to a tunnel excavation site, and the wireless initiation system and the wireless initiation method can be applied to an explosive operation in various blasting sites.

In the example described above, the display device 72 is attached to the wireless initiating detonator 10 via the cable 71; however, the display device 72 may be directly attached to the wireless initiating detonator 10. When the display device is directly attached to the wireless initiating detonator 10, the operator cannot check the display device after the wireless initiating detonator 10 is charged into the blast hole; however, the operator can charge the wireless initiating detonator 10 into the blast hole while checking the display device.

The invention claimed is:

1. A wireless initiating detonator comprising:

an initiator;

a controller connected to the initiator, and including an electric power storage unit capable of storing electric power for igniting the initiator;

a shell housing the initiator and the controller therein; and a detonator antenna used by the controller for wireless communication, and useable for both signal transmission and signal reception without an antenna only for signal transmission and an antenna only for signal reception being separately provided, wherein the detonator antenna is a soft magnetic coil antenna, and wherein the controller receives a transmission signal with an operation frequency via the detonator antenna, and converts the transmission signals into electric power in order to supply electric power for use in the controller and store electric power in the electric power storage unit, the operation frequency being a frequency which is greater than or equal to 100 kHz and is less than or equal to 500 kHz.

2. The wireless initiating detonator according to claim 1, wherein the detonator antenna is installed on an axis of a shell while being in contact with the shell, or is installed around the shell while being in contact with the shell.

3. The wireless initiating detonator according to claim 1, wherein the detonator antenna is located in such a manner as to be oriented in a predetermined direction via a leading wire without being in contact with the shell.

4. The wireless initiating detonator according to claim 1, wherein a display device is attached to the wireless initiating detonator directly or via a cable, and displays individual pieces of information by which the wireless initiating detonator can be identified.

5. An explosive unit that includes the wireless initiating detonator according to claim 1, and a primary charge which is an explosive, wherein the wireless initiating detonator is attached to the primary charge, wherein when the display device is attached to the wireless initiating detonator via a cable, a length of the cable is set such that the display device can reach an outside of the blast hole when the explosive unit is charged into the blast hole drilled into a blasting face.

6. A wireless initiation system comprising:

the explosive unit according to claim 5;

a blasting controller disposed at a remote position away from the blast hole, and configured to be able to wirelessly transmit the transmission signal to the wireless initiating detonator and to wirelessly receive a response signal from the wireless initiating detonator; and a blasting controller antenna used by the blasting controller for wireless communication, and useable for both signal transmission and signal reception without an antenna only for signal transmission and an antenna only for signal reception being separately provided, wherein the blasting controller antenna has a substantial loop shape, wherein when the controller receives the transmission signal from the blasting controller, the controller prepares a response signal corresponding to the received transmission signal, and transmits the prepared response signal with a response frequency higher than the operation frequency via the detonator antenna, and wherein the response frequency is set to a frequency corresponding to a wavelength longer than a loop length of the blasting controller antenna.

7. The wireless blast initiation system according to claim 6, wherein the response frequency exceeds the operation frequency, and is less than or equal to 10 MHz.

8. A wireless initiation method for blasting using the explosive unit according to claim 5, and a blasting controller configured to wirelessly transmit a transmission signal to the wireless initiating detonator and to wirelessly receive a response signal from the wireless initiating detonator, the method comprising:

a step of drilling the blast hole in the blasting face;

a step of charging the explosive unit into the blast hole;

a step of extending a blasting controller antenna in a substantial loop shape at a position a predetermined distance away from the blasting face, the blasting controller antenna being used by the blasting controller for wireless communication, and a length of the blasting controller antenna being set shorter than a wavelength corresponding to a response frequency of the response signal;

a step of transmitting a preparation start signal with an operation frequency, greater than or equal to 100 kHz, and less than or equal to 500 kHz, from the blasting controller via the blasting controller antenna, the preparation start transmission signal causing the wireless initiating detonator to prepare for blast initiation;

a step of starting a preparation of initiation using the controller when the preparation start signal is received via the detonator antenna;

a step of transmitting a preparation completion signal with the response frequency, exceeding the operation frequency corresponding to a wavelength longer than the length of the blasting controller antenna, and less than or equal to 10 MHz, from the controller to the blasting controller via the detonator antenna when preparation is completed, the preparation completion signal being a response signal indicative of the completion of preparation;

a step of transmitting an initiation execution signal, which is a transmission signal indicative of an execution of blast initiation, from the blasting controller when the preparation completion signal is received via the blasting controller antenna; and a step of igniting the initiator and initiating the detonator and the primary charge using the controller when the initiation execution signal is received via the detonator antenna.

9. The wireless initiation method according to claim 8, wherein when the display device is attached to the wireless initiating detonator via the cable with a length such that the display device can reach an outside of the blast hole, the primary charge is charged into the blast hole in such a manner that the display device can reach the outside of the blast hole.

* * * * *